US010661944B2

(12) United States Patent
Apps et al.

(10) Patent No.: US 10,661,944 B2
(45) Date of Patent: May 26, 2020

(54) PALLET WITH INSET DECK

(71) Applicant: Rehrig Pacific Company, Los Angeles, CA (US)

(72) Inventors: William P. Apps, Alpharetta, GA (US); Jon P. Hassell, Atlanta, GA (US); Mariel Rezende, Potomac, MD (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 15/730,051

(22) Filed: Oct. 11, 2017

(65) Prior Publication Data

US 2018/0099779 A1 Apr. 12, 2018

Related U.S. Application Data

(60) Provisional application No. 62/406,776, filed on Oct. 11, 2016.

(51) Int. Cl.

| | |
|---|---|
| ***B65D 19/38*** | (2006.01) |
| ***B65D 19/00*** | (2006.01) |
| ***B65D 19/04*** | (2006.01) |

(52) U.S. Cl.

CPC ..... *B65D 19/385* (2013.01); *B65D 19/0008* (2013.01); *B65D 19/04* (2013.01); *B65D 2519/00034* (2013.01); *B65D 2519/00069* (2013.01); *B65D 2519/0094* (2013.01); *B65D 2519/0096* (2013.01); *B65D 2519/00268* (2013.01); *B65D 2519/00288* (2013.01); *B65D 2519/00308* (2013.01); *B65D 2519/00318* (2013.01); *B65D 2519/00333* (2013.01); *B65D 2519/00338* (2013.01)

(58) Field of Classification Search

CPC ..... B65D 19/385; B65D 2519/0094; B65D 2519/0096; B65D 2519/00935

USPC ..... 108/53.1, 53.3

See application file for complete search history.

(56) References Cited

U.S. PATENT DOCUMENTS

| | | | | |
|---|---|---|---|---|
| 2,544,657 A | | 3/1951 | Cushman | |
| 2,602,619 A | | 7/1952 | McIntyre | |
| 2,699,912 A | | 10/1953 | Cushman | |
| 2,916,239 A | | 12/1959 | Stopps | |
| 3,404,642 A | * | 10/1968 | Belcher | B65D 19/0012 108/57.1 |
| 3,424,110 A | | 1/1969 | Toot | |
| 3,526,195 A | | 9/1970 | Maryonovich | |
| 3,636,888 A | * | 1/1972 | Angelbeck, Jr. | B65D 19/0014 108/53.1 |

(Continued)

FOREIGN PATENT DOCUMENTS

| | | |
|---|---|---|
| DE | 2125549 | 12/1972 |
| DE | 2232200 A1 | 1/1973 |

(Continued)

*Primary Examiner* — Jose V Chen

(74) *Attorney, Agent, or Firm* — Carlson, Gaskey & Olds, P.C.

(57) ABSTRACT

A pallet includes an upper deck including an upper support surface having a plurality of elongated recesses formed therein. A plurality of feet are below the upper deck. A plurality of runners connect lower portions of the plurality of feet. The plurality of runners are configured to be receivable in the plurality of elongated recesses formed in the upper surface of the upper deck of an identical pallet.

17 Claims, 10 Drawing Sheets

(56) References Cited

U.S. PATENT DOCUMENTS 3,636,889 A * 1/1972 Mangold ..... B65D 19/0012 108/53.1
3,640,229 A 2/1972 Bell
3,664,271 A 5/1972 Wolder et al.
3,680,496 A 8/1972 Westlake, Jr.
3,685,461 A 8/1972 Belcher
3,685,463 A 8/1972 Francis
D225,397 S 12/1972 Lindley
3,709,162 A 1/1973 Roper
3,720,176 A * 3/1973 Munroe ..... B65D 19/0051 108/53.1
3,750,596 A * 8/1973 Box ..... B65D 19/0014 108/53.1
3,832,955 A 9/1974 Pottinger et al.
4,013,021 A 3/1977 Steinlein et al.
4,016,230 A 4/1977 Michel
4,019,634 A 4/1977 Bonnot
4,133,270 A 1/1979 Ravera
4,242,150 A 12/1980 Maxwell
D258,948 S 4/1981 Stump, Jr.
4,263,855 A 4/1981 Lawlor
4,428,306 A 1/1984 Dresen et al.
4,487,136 A 12/1984 Beckway
4,597,338 A 7/1986 Kreeger
4,604,014 A 8/1986 Frano
4,606,278 A 8/1986 Shuert
4,735,154 A 4/1988 Hemery
4,801,024 A * 1/1989 Flum ..... A47F 7/281 108/53.1
4,850,284 A 7/1989 DeGroot et al.
4,865,202 A * 9/1989 Day ..... B65D 19/0018 100/2
4,879,956 A 11/1989 Shuert
5,042,396 A 8/1991 Shuert
5,046,434 A 9/1991 Breezer et al.
5,088,418 A 2/1992 Reckermann et al.
5,094,175 A 3/1992 Christie
5,117,762 A 6/1992 Shuert
5,168,817 A 12/1992 Nulle et al.
5,289,781 A 3/1994 Beckway
5,367,961 A 11/1994 Arai et al.
5,390,467 A 2/1995 Shuert
5,401,347 A 3/1995 Shuert
5,483,899 A 1/1996 Christie
5,520,120 A 5/1996 Badger
5,527,585 A 6/1996 Needham et al.
5,566,624 A 10/1996 Brown et al.
5,579,686 A 12/1996 Pigott et al.
5,606,921 A * 3/1997 Elder ..... B65D 19/0018 108/53.1
5,638,760 A 6/1997 Jordan et al.
5,664,934 A 9/1997 Schaede et al.
D388,931 S 1/1998 Constantino et al.
5,755,162 A 5/1998 Knight et al.
5,769,001 A 6/1998 Viessmann
5,769,003 A 6/1998 Rose et al.
5,791,262 A 8/1998 Knight et al.
5,806,436 A 9/1998 Weichenrieder, Sr. et al.
5,813,355 A 9/1998 Brown et al.
D400,682 S 11/1998 Constantino et al.
5,857,416 A 1/1999 Donnell, Jr. et al.
5,868,080 A 2/1999 Wyler et al.
5,950,545 A 9/1999 Shuert
5,964,162 A 10/1999 Chuan-Jen
5,996,508 A 12/1999 Constantino et al.
6,006,677 A 12/1999 Apps et al.
6,021,721 A 2/2000 Rushton
6,029,583 A 2/2000 LeTrudet
D423,752 S * 4/2000 Elder ..... D34/38
6,109,190 A 8/2000 Hale et al.
6,123,032 A 9/2000 Ohanesian
6,199,487 B1 3/2001 Coddington
6,209,464 B1 * 4/2001 Elder ..... B65D 19/004 108/53.3
6,283,044 B1 9/2001 Apps
6,289,823 B1 9/2001 Koefelda et al.
6,294,114 B1 9/2001 Muirhead
6,327,984 B1 12/2001 McCann et al.
6,367,630 B1 * 4/2002 Elskamp ..... B65D 19/04 206/508
6,446,563 B1 9/2002 Ohanesian
6,564,725 B2 5/2003 Hale
6,574,934 B1 6/2003 Queirel
6,622,642 B2 9/2003 Ohanesian
D485,659 S * 1/2004 Medoff ..... D34/38
6,705,237 B2 3/2004 Moore, Jr. et al.
6,718,888 B2 4/2004 Muirhead
6,742,460 B2 6/2004 Meyer et al.
6,886,475 B2 5/2005 Apps et al.
D513,104 S 12/2005 Harding et al.
6,976,437 B2 12/2005 Fisch et al.
6,997,113 B1 2/2006 Harding et al.
7,146,773 B2 12/2006 Wilson
7,293,509 B2 11/2007 Hassell
7,343,865 B2 3/2008 Shuert
7,360,493 B2 4/2008 Hummel et al.
7,549,259 B2 6/2009 Calle
7,690,315 B2 4/2010 Apps
7,779,765 B2 8/2010 Donnell, Jr. et al.
7,819,068 B2 10/2010 Apps et al.
7,845,113 B2 12/2010 Casimaty et al.
7,987,797 B2 8/2011 Stahl et al.
8,191,486 B2 6/2012 Apps et al.
8,196,527 B2 6/2012 Linares
8,230,793 B2 7/2012 Apps
8,448,583 B2 5/2013 Apps et al.
8,511,239 B2 * 8/2013 Lin ..... B65D 19/0038 108/53.1
D724,809 S 3/2015 Howland et al.
8,967,056 B2 3/2015 Apps et al.
D729,488 S 5/2015 Pulskamp et al.
9,169,040 B2 10/2015 Evans et al.
D753,392 S 4/2016 Haas et al.
D756,645 S 5/2016 Haas et al.
9,387,953 B2 7/2016 Takyar et al.
9,611,071 B2 4/2017 Baltz et al.
9,745,099 B2 * 8/2017 Takyar ..... B65D 19/0018
2001/0029874 A1 10/2001 Muirhead
2002/0017225 A1 2/2002 Koefelda et al.
2002/0104465 A1 8/2002 Ohanesian
2002/0134284 A1 9/2002 Apps
2002/0148393 A1 * 10/2002 Milles ..... B65D 19/0018 108/53.1
2004/0134390 A1 7/2004 Apps et al.
2004/0168618 A1 9/2004 Muirhead
2005/0103237 A1 5/2005 Moore, Jr. et al.
2005/0145145 A1 7/2005 Ogburn et al.
2005/0211139 A1 9/2005 Perrotta et al.
2005/0263043 A1 * 12/2005 Proudlove ..... B65D 19/0018 108/56.3
2006/0032411 A1 2/2006 Hummel et al.
2006/0254476 A1 11/2006 MacDonald et al.
2006/0272556 A1 * 12/2006 Apps ..... B65D 19/004 108/53.1
2008/0060561 A1 3/2008 Carrasco
2008/0143514 A1 6/2008 Valentinsson
2008/0210140 A1 9/2008 Valentinsson
2008/0236454 A1 10/2008 Naidu et al.
2008/0295748 A1 12/2008 Yoshida et al.
2009/0241461 A1 * 10/2009 Linares ..... B65D 19/0038 52/592.1
2010/0043678 A1 2/2010 Linares
2010/0083881 A1 4/2010 Apps et al.
2010/0326334 A1 * 12/2010 Lin ..... B65D 19/0018 108/53.1
2011/0100268 A1 5/2011 Milkowski et al.
2011/0139040 A1 6/2011 Apps et al.
2011/0232539 A1 * 9/2011 Broerman ..... B65D 19/0036 108/53.1
2011/0259249 A1 10/2011 Ogburn et al.
2012/0160734 A1 6/2012 Linares
2012/0291678 A1 11/2012 Howland et al.

(56) References Cited

U.S. PATENT DOCUMENTS

| | | | | |
|---|---|---|---|---|
| 2013/0081971 | A1* | 4/2013 | Ritzberger | B65D 19/02 206/511 |
| 2014/0000493 | A1 | 1/2014 | Apps et al. | |
| 2014/0283713 | A1 | 9/2014 | Baltz et al. | |
| 2014/0345500 | A1* | 11/2014 | Dunn | B65D 19/0016 108/53.3 |
| 2015/0040803 | A1* | 2/2015 | Burk | B65D 19/0038 108/53.3 |
| 2015/0108037 | A1 | 4/2015 | Evans et al. | |
| 2015/0135999 | A1 | 5/2015 | Takyar et al. | |
| 2015/0274359 | A1* | 10/2015 | Linares | B65D 19/38 108/53.1 |
| 2016/0167831 | A1* | 6/2016 | Suiter | B65D 19/0018 108/53.1 |
| 2016/0318656 | A1 | 11/2016 | Takyar et al. | |
| 2016/0318657 | A1 | 11/2016 | Takyar et al. | |

FOREIGN PATENT DOCUMENTS

| | | |
|---|---|---|
| DE | 2613083 A1 | 10/1977 |
| DE | 2733457 | 2/1979 |
| DE | 3806097 | 9/1989 |
| EP | 202203 | 11/1986 |
| EP | 849184 | 6/1998 |
| EP | 2028117 | 2/2009 |
| EP | 2724956 | 4/2014 |
| FR | 1449377 | 8/1966 |
| FR | 2206248 | 6/1974 |
| FR | 2259023 | 8/1975 |
| FR | 2274512 | 1/1976 |
| FR | 2486029 | 1/1982 |
| GB | 859186 | 1/1961 |
| GB | 901340 | 7/1962 |
| GB | 2272203 | 5/1994 |
| HU | 9303243 | 3/1994 |
| HU | 9900326 | 5/1999 |
| JP | 53058581 | 5/1978 |
| JP | 04114859 | 4/1992 |
| JP | 06179448 | 6/1994 |
| JP | 06191536 | 7/1994 |
| JP | 2008114913 | 5/2008 |
| WO | 9411262 | 5/1994 |
| WO | 2004063035 | 7/2004 |
| WO | 2005068309 | 7/2005 |
| WO | 2005118412 | 12/2005 |
| WO | 2009099314 | 8/2009 |
| WO | 2010008264 | 1/2010 |

* cited by examiner

PALLET WITH INSET DECK

BACKGROUND

Pallets are often used to store goods for easy shipping. The pallet includes a deck having an upper surface for supporting the goods thereon. The deck is supported above a floor, such as by feet, so that the loaded pallet can be lifted by the tines of a forklift, pallet jack, etc.

When empty, the pallets are stacked on one another and either stored or shipped back to a warehouse or other facility to be reloaded. The stacking height of the empty pallets affects the efficiency of the storing and shipping of the pallets.

Some pallets are "nestable" to decrease the stacking height when empty, i.e. the feet of one pallet can be received in openings through the deck of a lower pallet and partially into the hollow feet of the lower pallet. The decks of the stacked pallets may be very close to one another when nested.

Some pallets include "runners" connecting lower portions of the feet. This can improve the stability of the pallet, especially when being moved by a conveyor. However, the runners prevent the pallets from being nestable.

SUMMARY

A pallet includes an upper deck including an upper support surface having a plurality of elongated recesses formed therein. A plurality of feet are below the upper deck. A plurality of runners connect lower portions of the plurality of feet. The plurality of runners are configured to be receivable in the plurality of elongated recesses formed in the upper surface of the upper deck of an identical pallet.

The plurality of elongated recesses each may include an elongated portion for receiving one of the runners and a foot portion for receiving one of the feet. At least one of the plurality of elongated recesses may include at least one projecting interlocking element projecting upward from the at least one elongated recess. The recesses in the upper deck do not extend below a lower surface of the deck.

The at least one projecting interlocking element may be formed in the elongated portion of the at least one elongated recess or in the foot portion of the at least one elongated recess.

The pallet may be formed as two pieces: an upper portion including the deck and a lower portion including the plurality of feet and the plurality of runners. The lower portion may further include a plurality of lower deck portions formed at upper ends of the feet and secured to an underside of the deck.

DETAILED DESCRIPTION OF A PREFERRED EMBODIMENT

Figure 1:
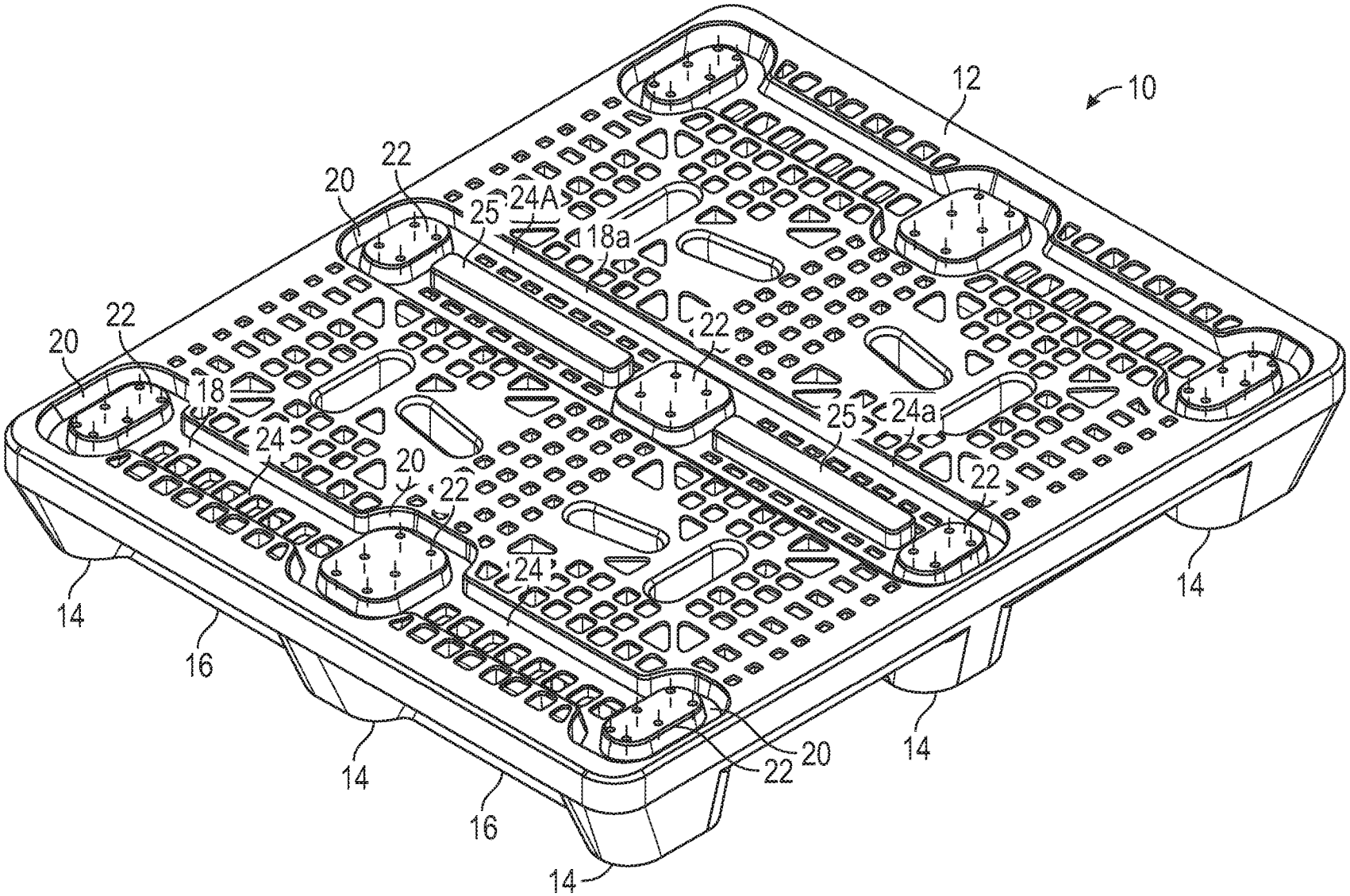
FIG. 1 is a perspective view of a pallet according to a first example embodiment.

A pallet 10 according to one embodiment is shown in FIG. 1. The pallet 10 includes a deck 12 supported above the floor by a plurality of supports or feet 14. In this example, the pallet 10 includes three rows of three feet 14. The feet 14 within each row are connected by runners 16 at lower ends thereof. Aligned with each row of feet 14 is a recess 18 formed in the upper surface of the deck 12. Each recess 18 is formed to receive the feet 14 and runners 16 of an identical pallet 10 when stacked on the pallet 10. Each recess 18 includes a foot recess 20 aligned above each of the feet 14 and having an upwardly-projecting interlocking element 22 generally in the center thereof. Each recess 18 also includes an elongated runner recess 24 between the foot recesses 20 and aligned above each runner 16.

In the example pallet 10 shown, the recesses 18 of the outer rows include runner recesses 24 that are narrower than the foot recesses 20, but in the center row the recess **18*a* includes runner recesses 24*a* that are as wide as the foot recesses 20 (to accommodate an optional wider runner in the center of the pallet 10). Each of the center runner recesses 24*a* includes an elongated upwardly-projecting interlocking element 25 generally in the center thereof. The example pallet 10** is a 48"×40" pallet, but pallets of other dimensions and aspect ratios could also include the features described herein.

Figure 2:
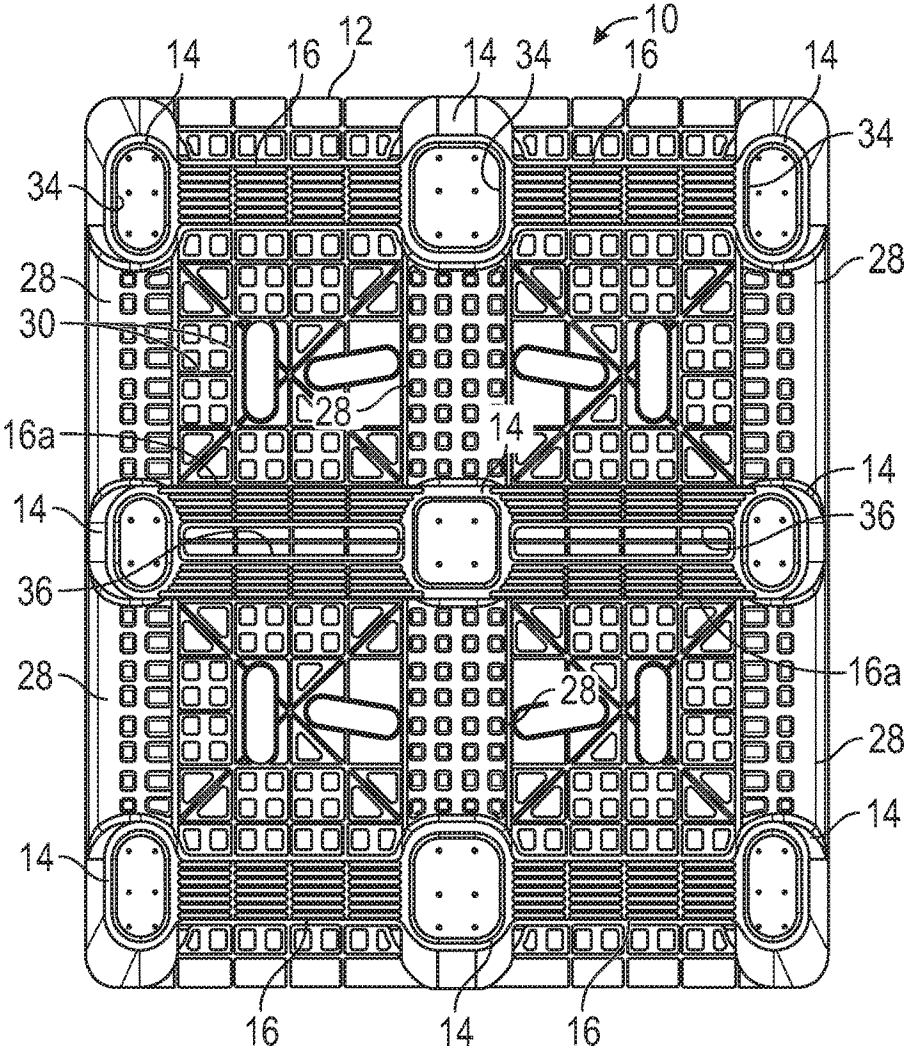
FIG. 2 is a bottom view of the pallet of FIG. 1.

FIG. 2 is a bottom view of the pallet 10. As shown, the runners 16 extend across each of the three rows of feet 14. Lower deck portions 28 extend between adjacent pair of feet 14 in a direction perpendicular to the runners 16. The lower deck portions 28 connect upper portions of each of the feet 14. The lower deck portions 28 include ribs that mate with ribs 30 on an underside of the deck 12. The bottom of each foot 14 includes a peripheral rib circumscribing a downwardly open recess 34. Undersides of the runners 16 (which include outer runners 16 and center runner **16*a*) include ribs extending downwardly. The center runner 16*a* may be wider than the outer runners 16 (as shown) and may include an elongated recess 36 centered in each center runner 16*a* and extending from foot 14 to foot 14. The elongated recesses 36 are each configured in size, shape and location to receive one of the interlocking elements 25 therein when stacked on a similar pallet 10**.

Figure 3:
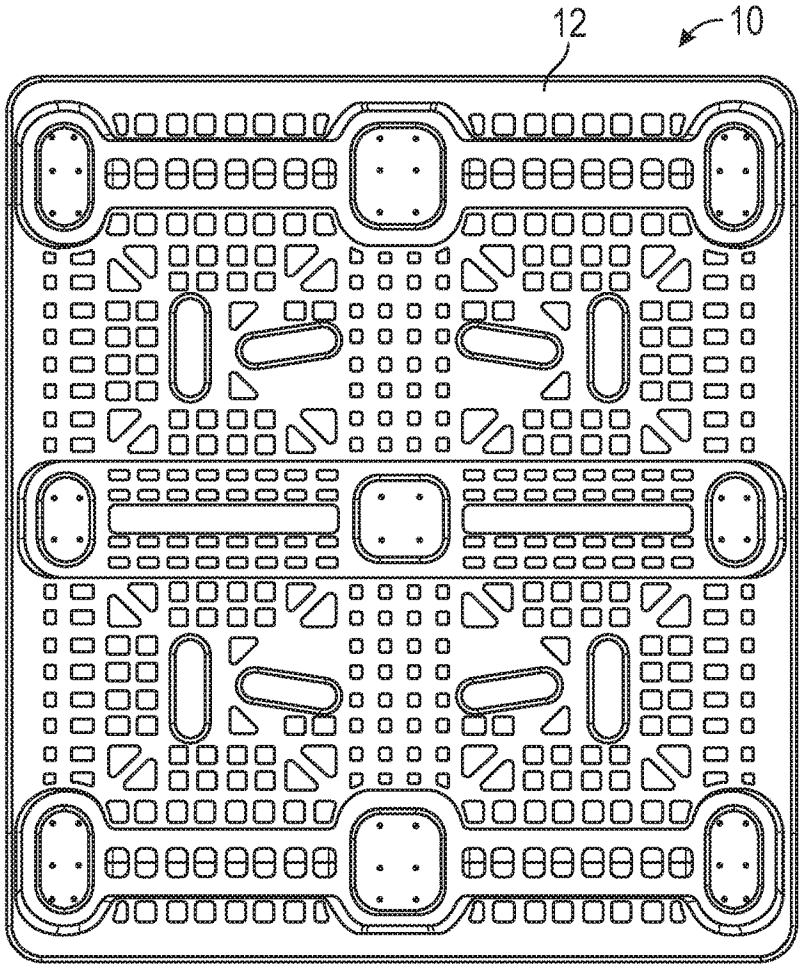
FIG. 3 is a top view of the pallet of FIG. 1.
Figure 4:
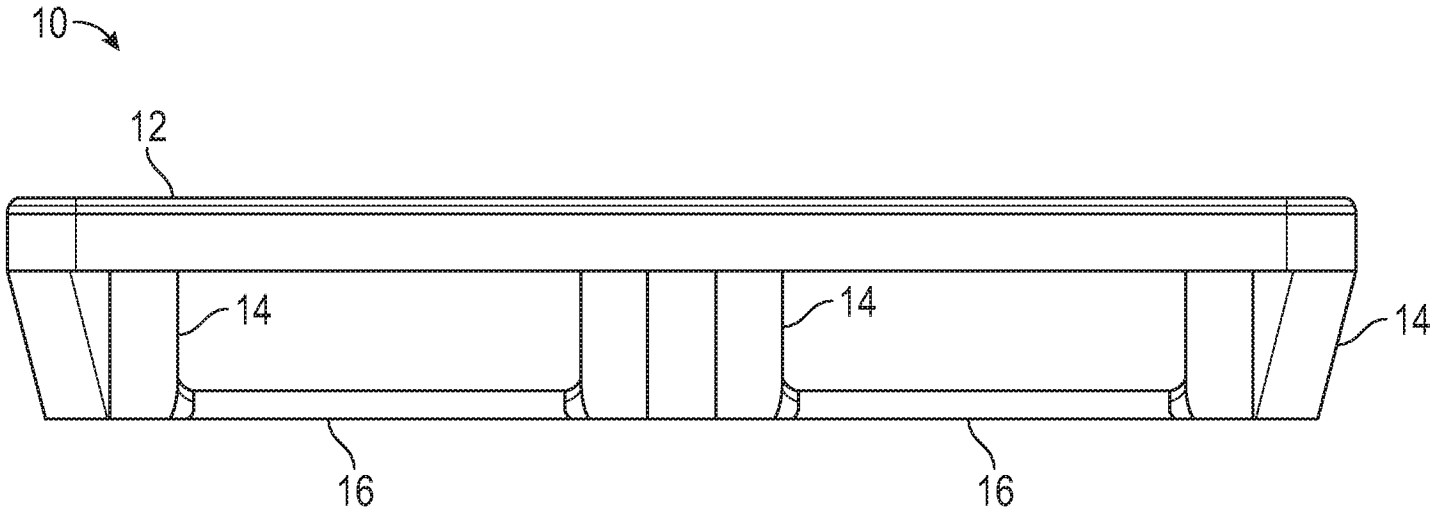
FIG. 4 is a front view of the pallet.
Figure 5:
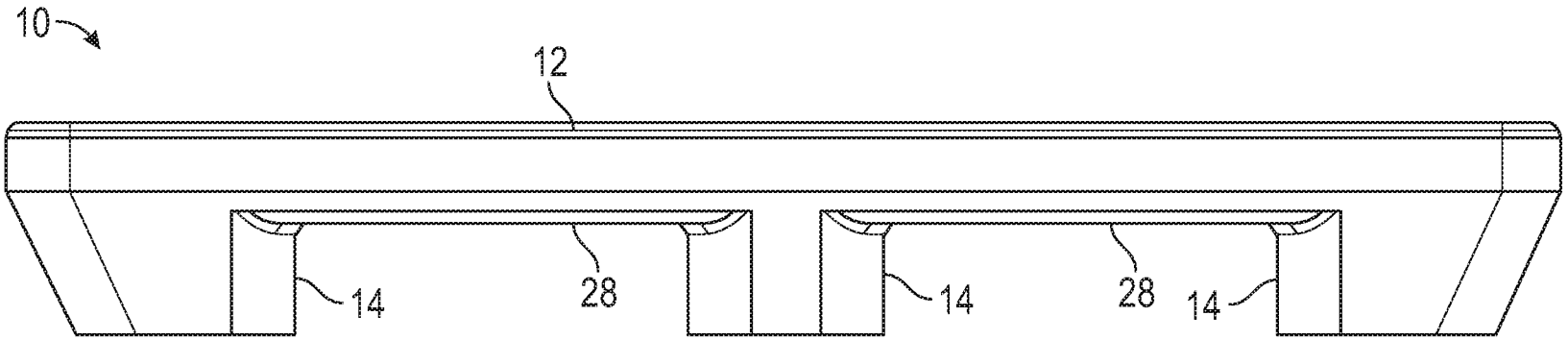
FIG. 5 is a side view of the pallet.

FIG. 3 is a top view of the pallet 10. FIG. 4 is a front view of the pallet 10. FIG. 5 is a side view of the pallet 10. As shown in FIGS. 4 and 5, the outer (i.e. at the perimeter of the pallet 10) walls of the feet 14 slope inward toward the bottom edges of the feet 14. The other (non-perimeter) walls of the feet 14 are relatively vertical and generally perpendicular to the deck 12.

Figure 6:
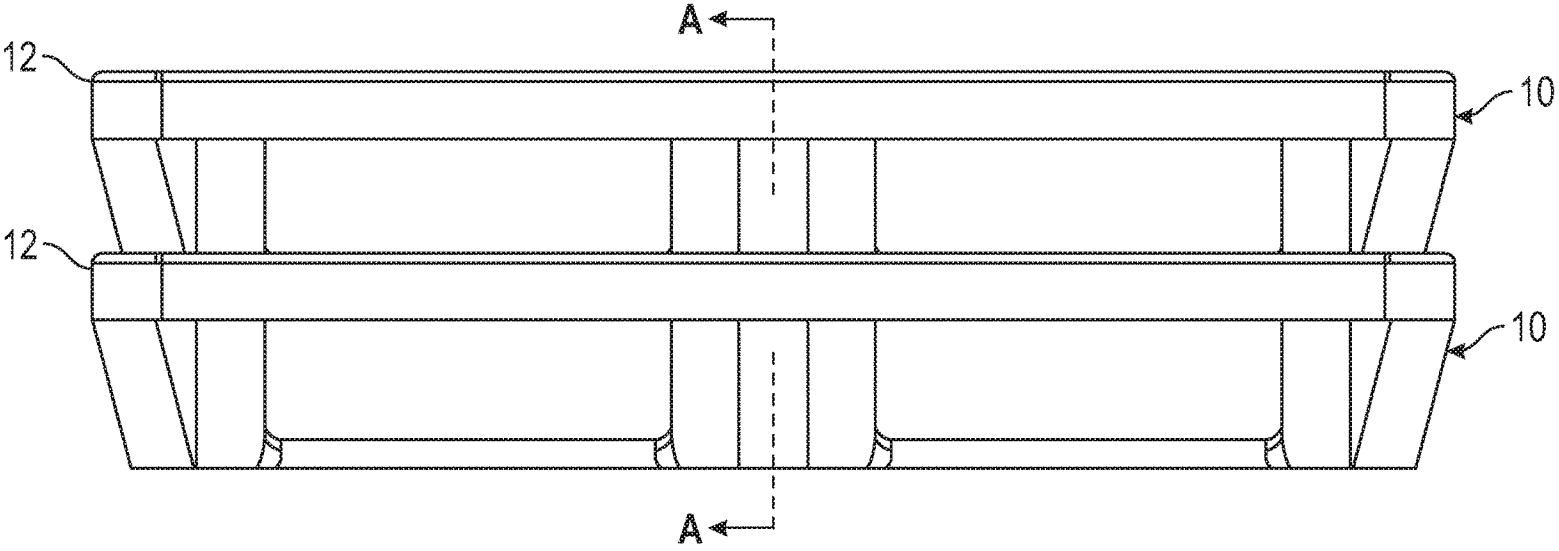
FIG. 6 is a front view of the pallet stacked on an identical pallet.
Figure 7:
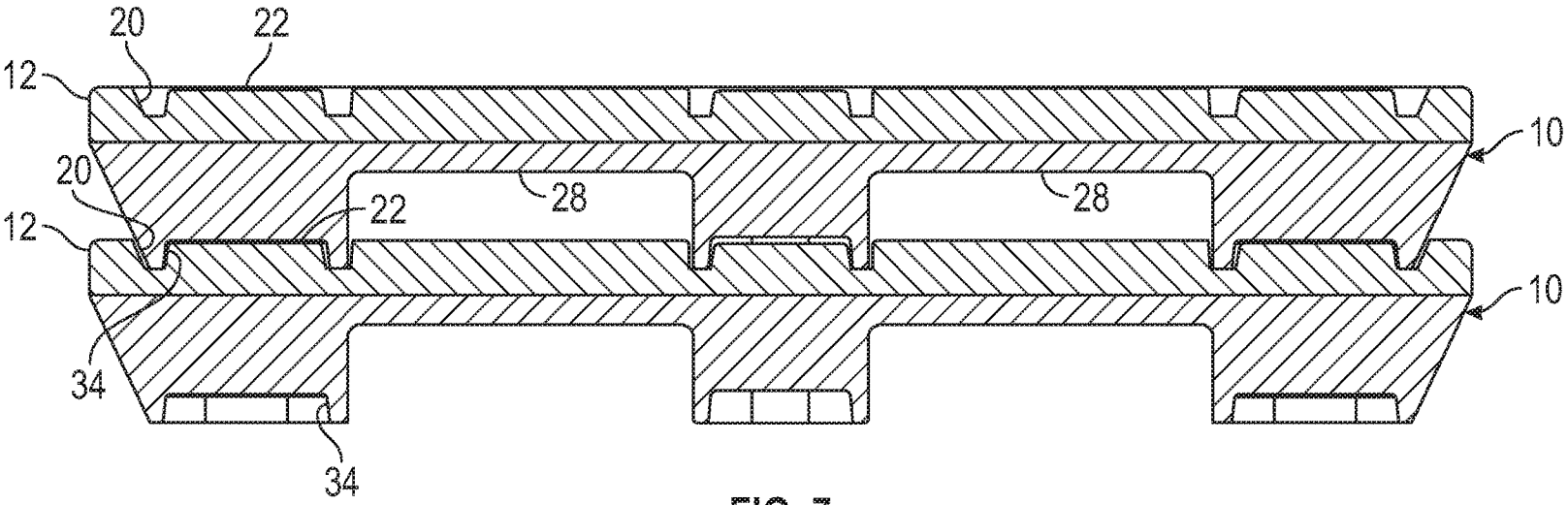
FIG. 7 is a section view taken along line A-A of FIG. 6.

FIG. 6 is a front view of the pallet 10 stacked on an identical pallet 10. FIG. 7 is a section view taken along line A-A of FIG. 6. As shown, the upper pallet 10 is received securely in the recesses of the lower pallet 10. The feet 14 of the upper pallet 10 are received in the foot recesses 20 of the lower pallet 10. The upwardly-projecting interlocking element 22 in each foot recess 20 is received in the recess 34 of each foot 14.

Figure 8:
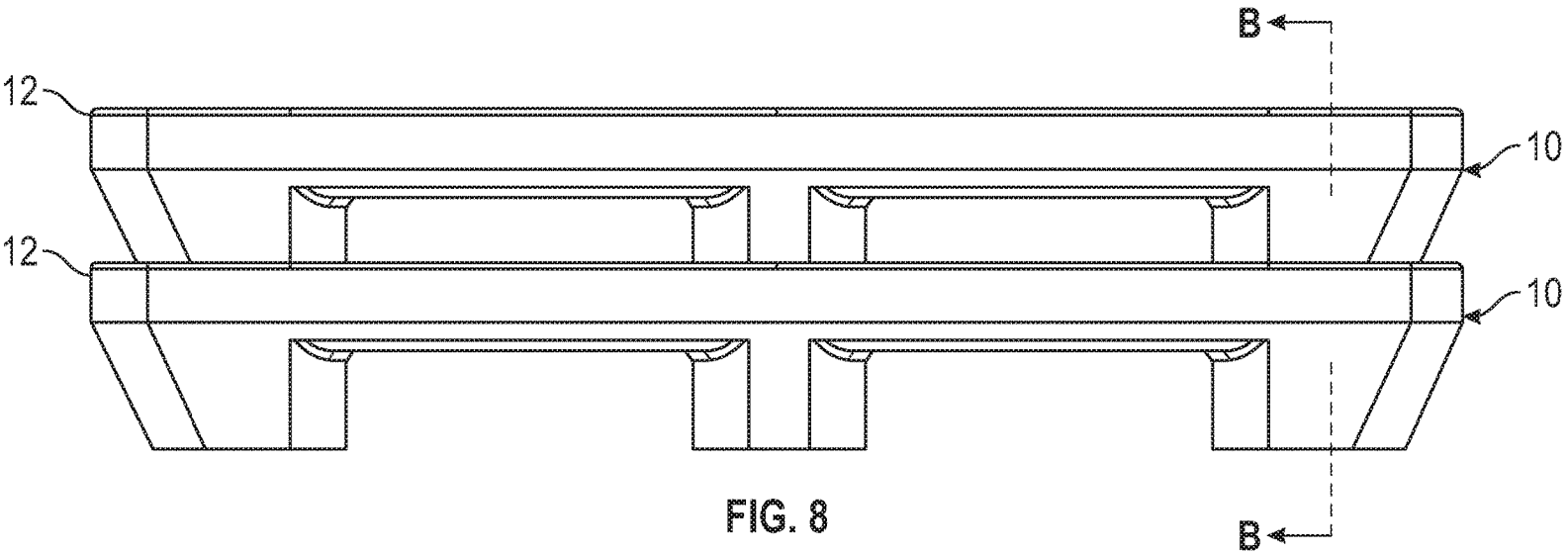
FIG. 8 is a side view of the stacked pallets of FIG. 6.
Figure 9:
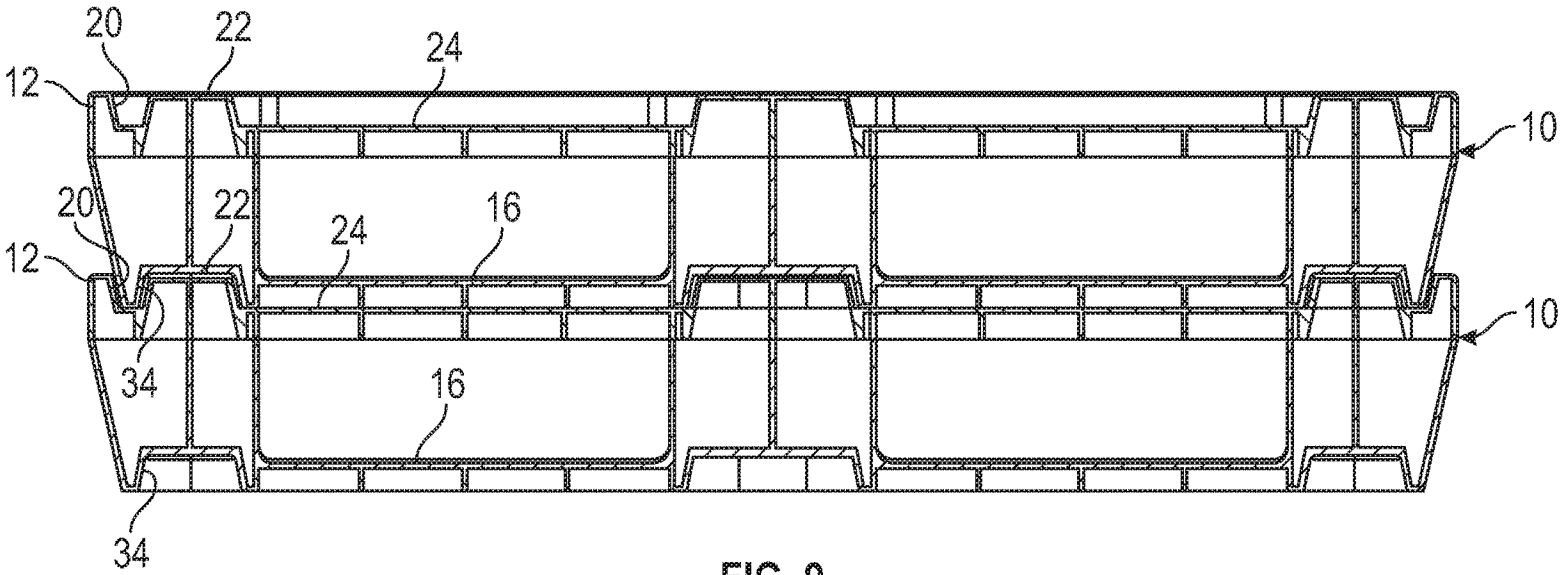
FIG. 9 is a section view taken along line B-B of FIG. 8.

FIG. 8 is a side view of the stacked pallets 10. FIG. 9 is a section view taken along line B-B of FIG. 8. As shown, the upper pallet 10 is received securely in the recesses of the lower pallet 10. The feet 14 of the upper pallet 10 are received in the foot recesses 20 of the lower pallet 10. The upwardly-projecting interlocking element 22 in each foot recess 20 is received in the recess 34 of each foot 14. This helps to prevent a stack of empty pallets 10 from sliding relative to one another during shipping.

The example pallet 10 is formed in two pieces which are subsequently joined. Other ways could be used to make the pallet 10. In the example pallet 10, a lower portion is integrally molded as a single piece of plastic, such as by injection molding, and includes the feet 14, runners 16, and lower deck portions 28. An upper portion includes the deck 12. The upper portion may be connected to the lower portion via vibration welding, hot plate welding, heat stakes, snap fit connections or other known connection methods.

Figure 11:
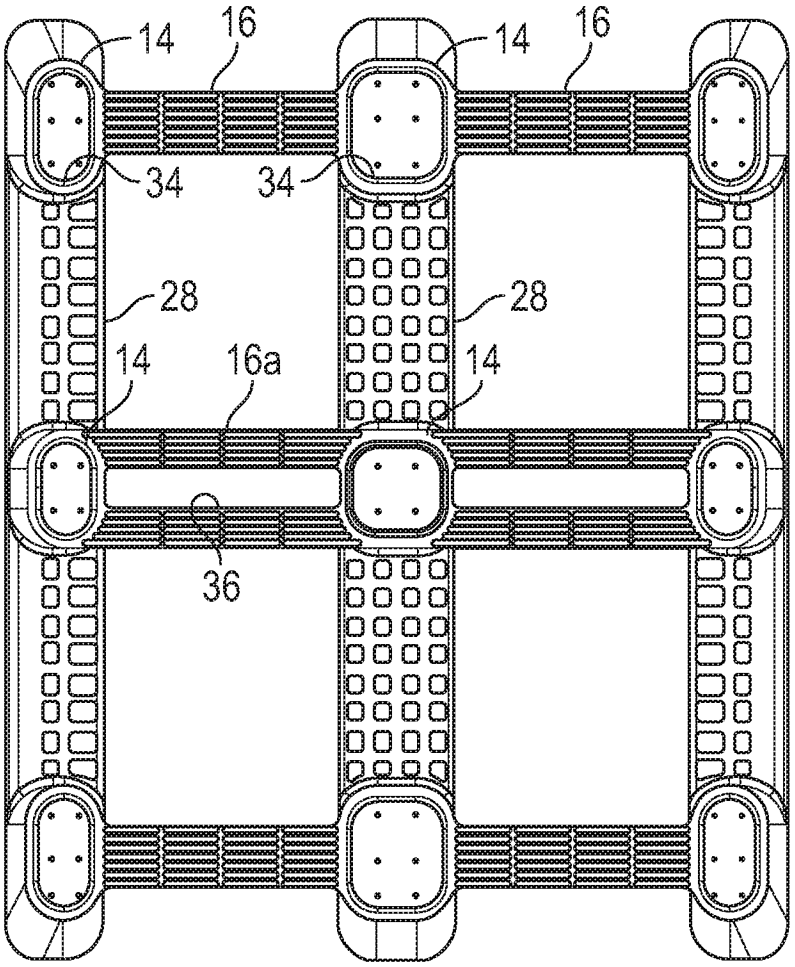
FIG. 11 is a bottom view of the lower portion of the pallet.
Figure 10:
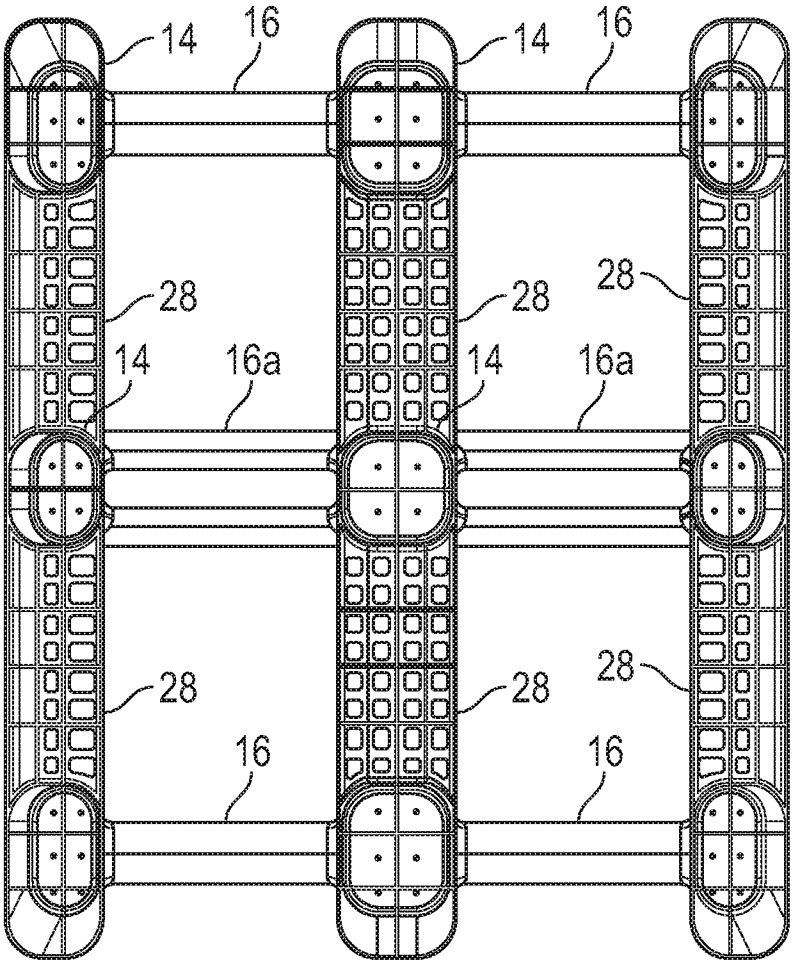
FIG. 10 is a top view of the lower portion of the pallet.
Figure 13:
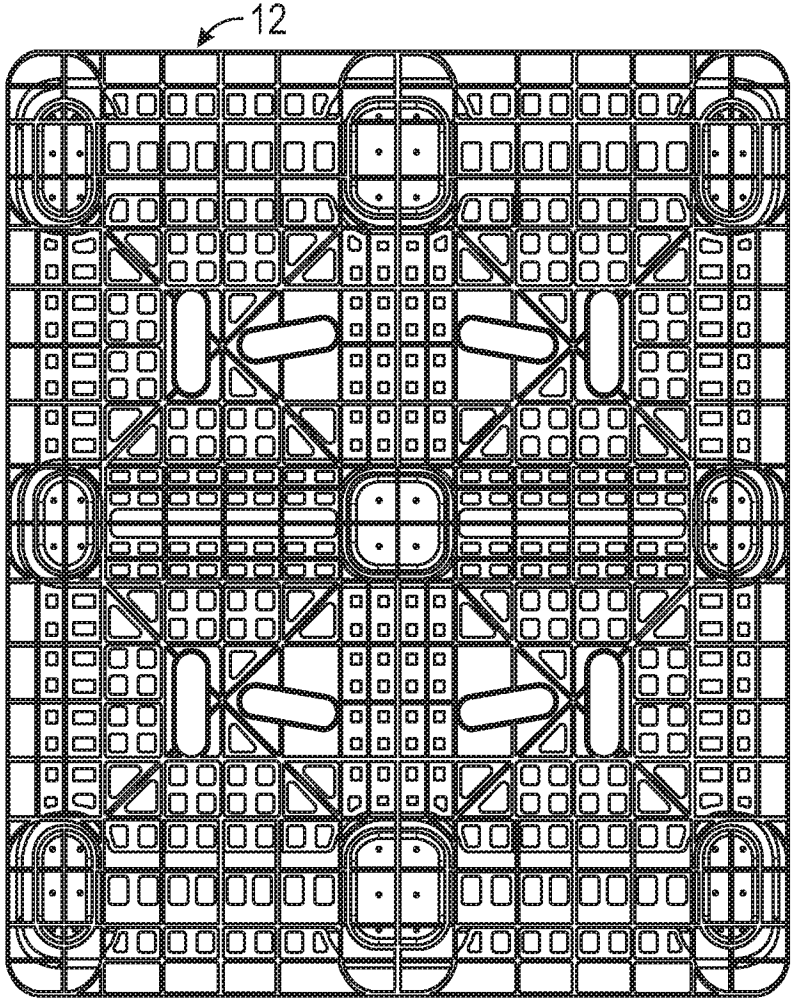
FIG. 13 is a bottom view of the upper portion of the pallet.
Figure 12:
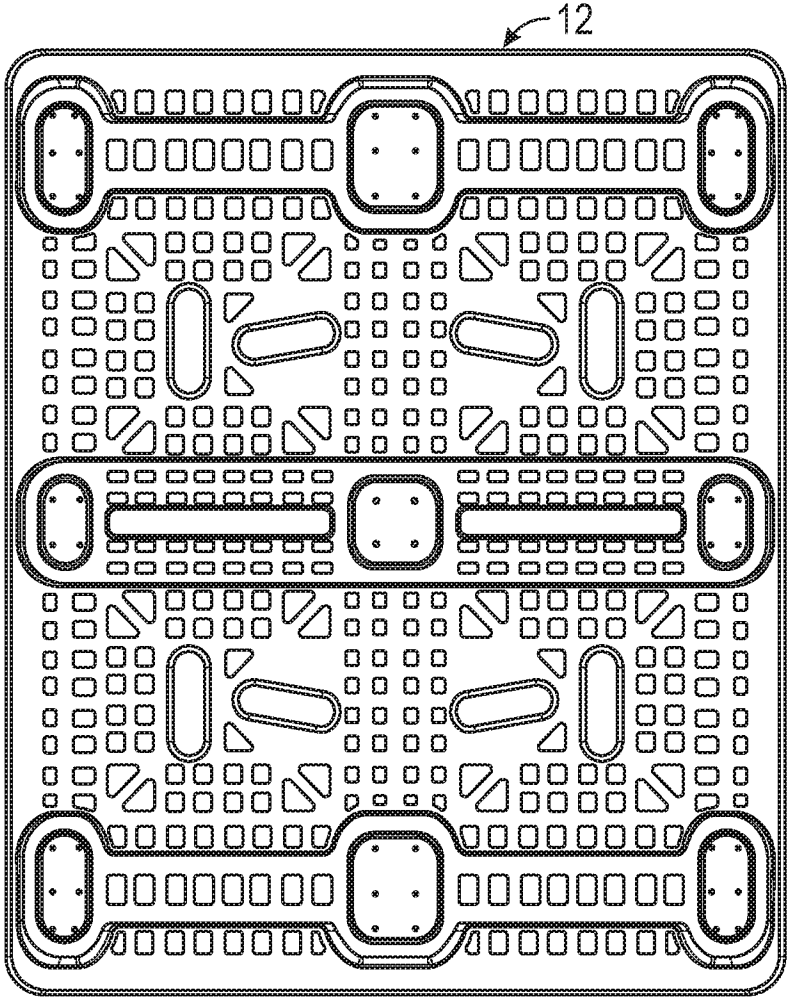
FIG. 12 is a top view of the upper portion of the pallet.

The lower portion of the pallet 10 is shown in FIG. 10 (top view) and FIG. 11 (bottom view). The upper portion of the pallet 10 is shown in FIG. 12 (top view) and FIG. 13 (bottom view).

Figure 14:
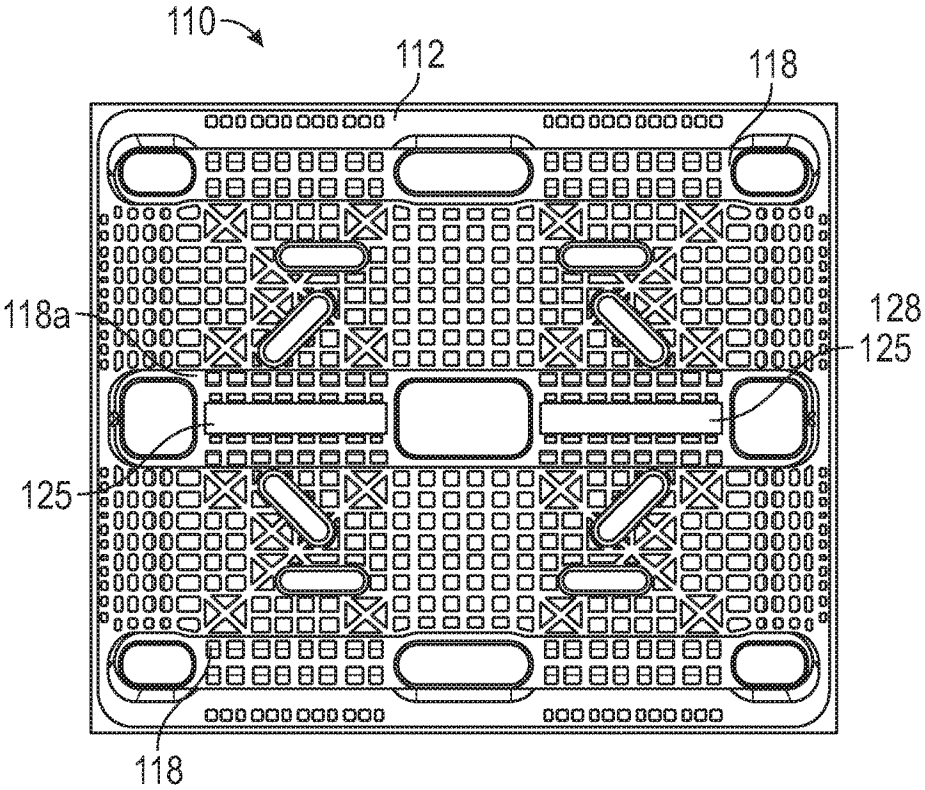
FIG. 14 is a top view of a second example pallet.

FIG. 14 is a top view of a second example pallet 110. The pallet 110 is similar to the pallet 10 of FIGS. 1-13 except as described below or shown in the drawings. Primarily, the pallet 110 includes a deck 112 with recesses 118 extending parallel to the long dimension of the pallet 110. For example, in a 48"×40" pallet, the recesses 118 extend parallel to the 48" dimension. Again, the center recess 118*a* includes an elongated upwardly-projecting interlocking element 125 generally in the center thereof.

Figure 15:
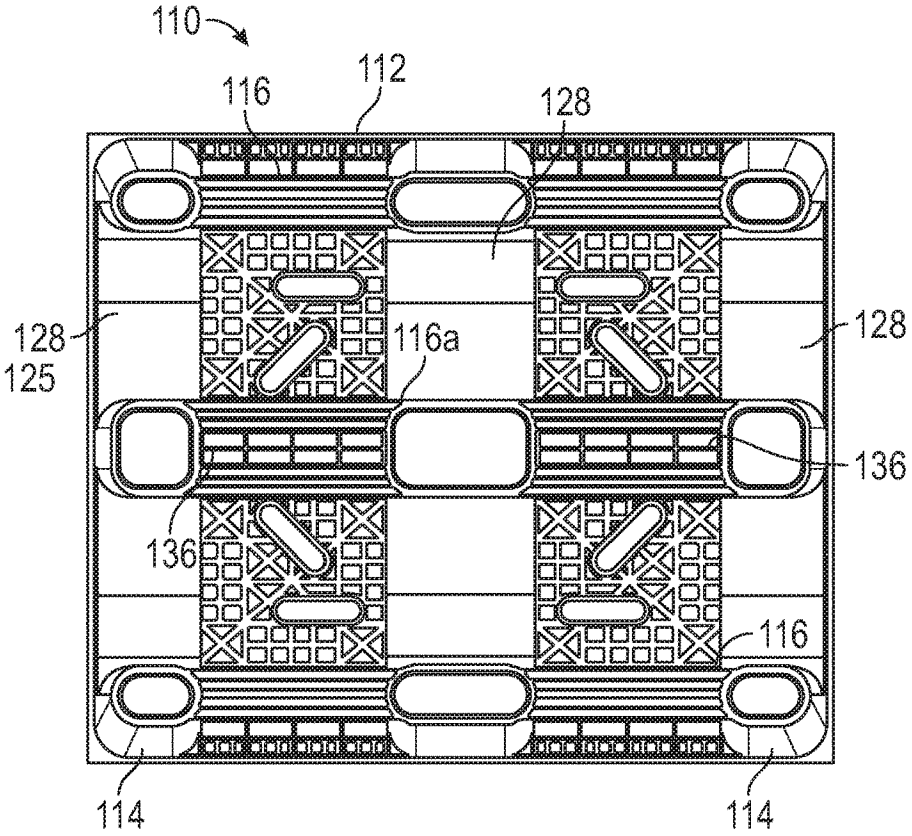
FIG. 15 is a bottom view of the pallet of FIG. 14.

FIG. 15 is a bottom view of the pallet 110. Runners 116 extend across each of the three rows of feet 114. Lower deck portions 128 extend between adjacent pair of feet 114 in a direction perpendicular to the runners 116. The lower deck portions 128 connect upper portions of each of the feet 14, in this example, parallel to the shorter (e.g. 40") dimension of the deck 112. The lower deck portions 128 include ribs that mate with ribs on an underside of the deck 112. The bottom of each foot 114 includes a peripheral rib circumscribing a downwardly open recess. Undersides of the runners 116 (which include outer runners 116 and center runner 116*a*) include ribs extending downwardly. The center runner 116*a* may be wider than the outer runners 116 (as shown) and may include an elongated recess 136 centered in the center runner 116*a* and extending from foot 114 to foot 114. The elongated recesses 136 are each configured in size, shape and location to receive one of the interlocking elements 125 therein when stacked on a similar pallet 110.

Figure 17:
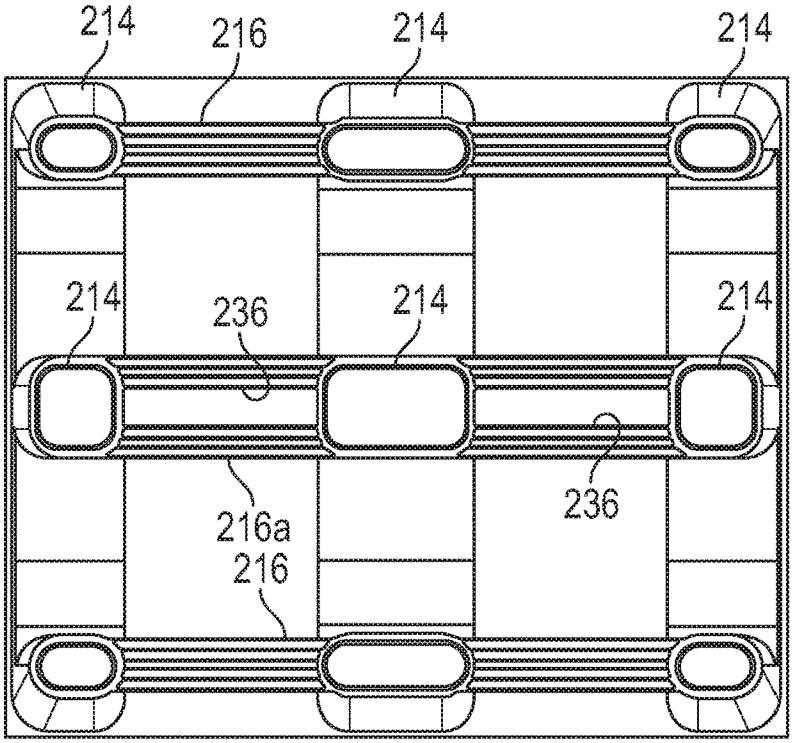
FIG. 17 is a bottom view of the lower portion of FIG. 16.
Figure 16:
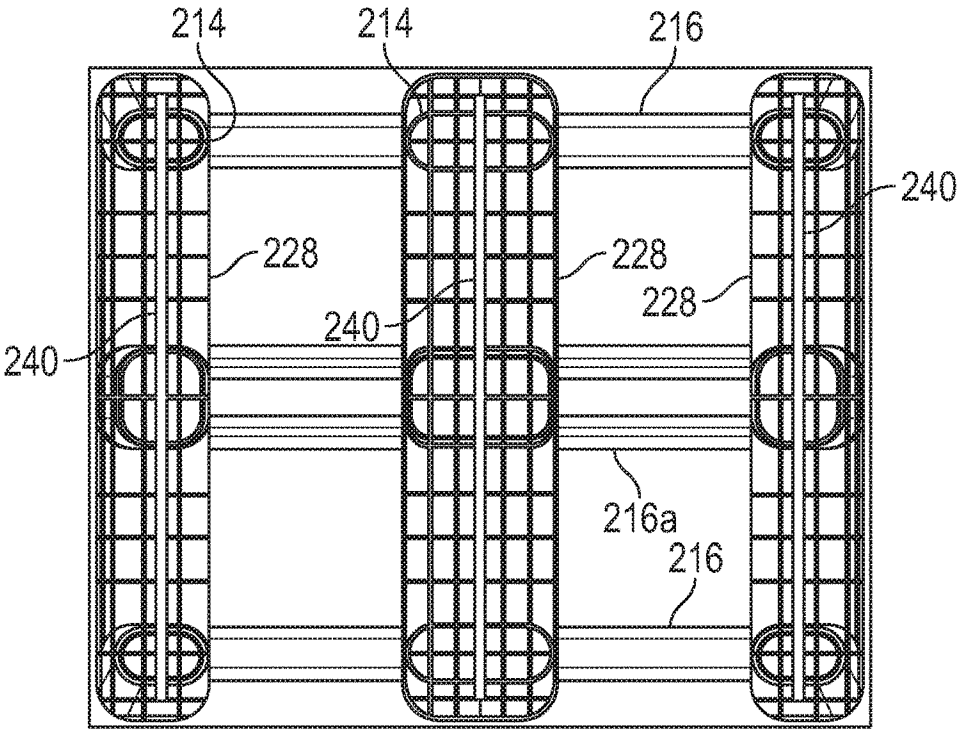
FIG. 16 is a top view of a lower portion of the pallet of FIG. 18.
Figure 18:
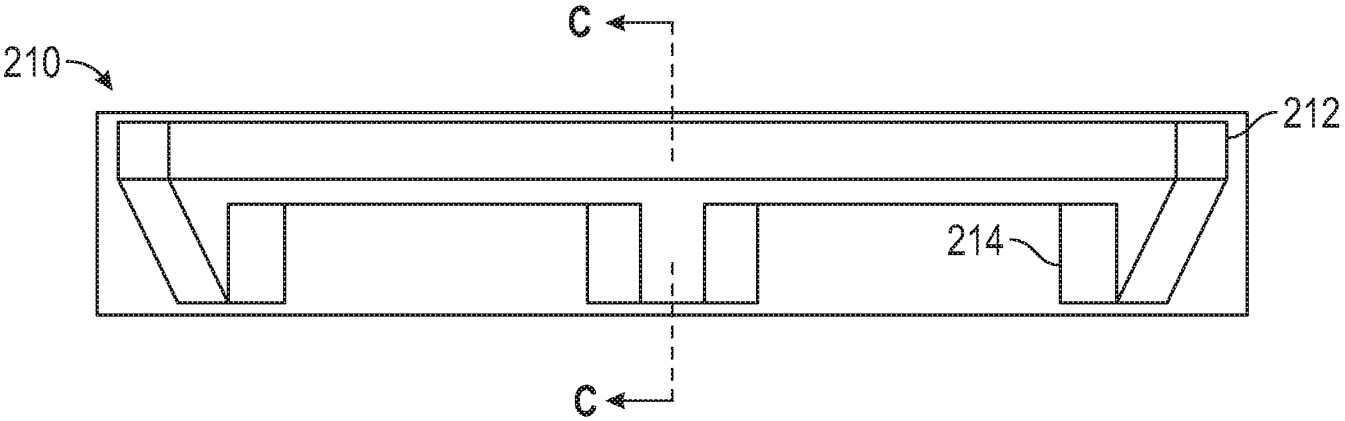
FIG. 18 is a side view of a pallet according to a third example.
Figure 19:
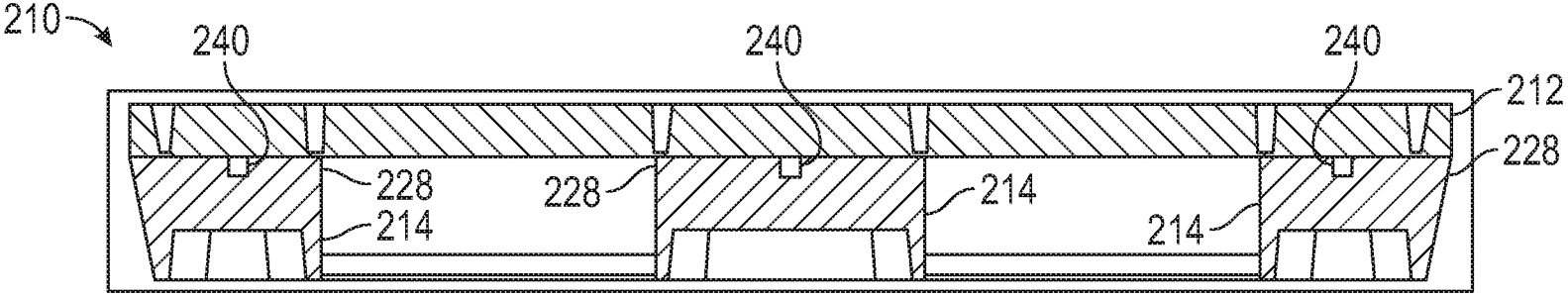
FIG. 19 is a section view taken along line C-C of FIG. 18.

FIGS. 16 and 17 are top and bottom views, respectively, of a lower portion of a third example pallet 210, which is shown more completely in FIGS. 18 and 19. The pallet 210 is similar to that of FIGS. 1-13, except as shown in the Figures or described below. Notably, referring to FIG. 16, the pallet 210 includes a plurality of reinforcement rods 240 secured in channels formed in the lower deck portions 228. The reinforcement rods 240 may be metal or a stiffer polymer or composite and they may be solid or have a rectangular (or square) cross section or an I-beam cross section. The reinforcement rods 240 add stiffness to the deck 212.

Referring again to FIG. 16, the lower portion of the pallet includes a plurality of feet 214 extending from the lower deck portions 228 to the runners 216. The lower deck portions 228 extend perpendicularly to the runners 216, as before.

As shown in FIG. 17, the central runner 216*a* may include elongated recesses 236. FIG. 18 is a side view of the assembled pallet 210. The sloped outer walls of the pallet 210 prevent the pallet 210 from being racked (placed on a rack that only supports the pallet 210 at outer edges of the feet 214). Alternatively, the outer walls could be straight so that the pallet 210 could be racked.

FIG. 19 is a section taken along line C-C of FIG. 18. The reinforcement rods 240 are received in the channels at the upper edges of the lower deck portions 228, above the feet 214 and below the deck 212.

In each of the embodiments, the runners are received in the recesses formed in the upper surface of a deck of an identical pallet stacked therebelow. This provides a more stable stack and a reduced stacking height when empty pallets are stacked. No portion of the feet of the upper pallet extend below the bottom surface of the deck of the lower pallet, or into the feet of the lower pallet, so it may be said that these pallets are not truly "nestable," but simply provide a moderately reduced stacking height and a more stable stack than pallets without the interlocking features of the runners and upper deck.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pallet comprising:

an upper deck including an upper support surface having a plurality of elongated recesses formed therein;

a plurality of feet below the upper deck; and a plurality of runners connecting the plurality of feet, wherein portions of the plurality of runners between the plurality of feet are configured to be receivable in the plurality of elongated recesses formed in the upper surface of the upper deck of an identical pallet, wherein the plurality of elongated recesses each include an elongated portion for receiving one of the portions of one of the runners between two immediately adjacent feet of the plurality of feet of the identical pallet and two foot portions for receiving the two immediately adjacent feet of the identical pallet.

2. A pallet comprising:

an upper deck including an upper support surface having a plurality of elongated recesses formed therein;

a plurality of feet below the upper deck; and a plurality of runners connecting the plurality of feet, wherein portions of the plurality of runners between the plurality of feet are configured to be receivable in the plurality of elongated recesses formed in the upper surface of the upper deck of an identical pallet, wherein the plurality of elongated recesses each include an elongated portion for receiving one of the portions of one of the runners and a foot portion for receiving one of the feet, wherein at least one of the plurality of elongated recesses includes at least one projecting interlocking element projecting upward from the at least one elongated recess.

3. The pallet of claim 2 wherein the at least one projecting interlocking element is formed in the elongated portion of the at least one elongated recess.

4. The pallet of claim 2 wherein the at least one projecting interlocking element is formed in the foot portion of the at least one elongated recess.

5. The pallet of claim 4 further including an upper portion including the deck and a lower portion including the plurality of feet and the plurality of runners.

6. The pallet of claim 5 wherein the recesses in the upper deck do not extend below a lower surface of the deck.

7. The pallet of claim 5 wherein the lower portion further includes a plurality of lower deck portions formed at upper ends of the feet and secured to an underside of the deck, wherein the runners are formed at lower ends of the feet.

8. The pallet of claim 7 wherein the lower portion is integrally molded as a single piece of plastic.

9. The pallet of claim 8 further including a plurality of reinforcement rods between the deck and the lower deck portions.

10. The pallet of claim 1 further including an upper portion including the deck and a lower portion including the plurality of feet and the plurality of runners.

11. The pallet of claim 10 wherein the lower portion further includes a plurality of lower deck portions formed at upper ends of the feet and secured to an underside of the deck, wherein the runners are formed at lower ends of the feet, wherein the lower portion is integrally molded as a single piece of plastic.

12. The pallet of claim 11 further including a plurality of reinforcement rods between the deck and the lower deck portions.

13. The pallet of claim 1 wherein outer walls of the plurality of feet at the periphery of the pallet slope inward toward a lower portion of the feet.

14. The pallet of claim 13 wherein walls other than the outer walls of the plurality of feet are generally perpendicular to the deck.

15. A pallet comprising:

an upper deck including an upper support surface having a plurality of recesses formed therein, wherein at least one of the plurality of recesses includes at least one projecting interlocking element projecting upward from the at least one recess;

a plurality of feet below the upper deck, the plurality of feet including first pair of immediately adjacent feet; and a plurality of runners connecting the plurality of feet, wherein a first one of the plurality of runners includes a portion between the first pair of immediately adjacent feet, wherein the portion is configured to be receivable in the plurality of recesses formed in the upper surface of the upper deck of an identical pallet.

16. The pallet of claim 15 wherein the recesses in the upper deck do not extend below a lower surface of the deck.

17. A pallet comprising:

an upper deck including an upper support surface having a plurality of elongated recesses formed therein;

a plurality of feet below the upper deck; and a plurality of runners connecting the plurality of feet, wherein portions of the plurality of runners between the plurality of feet are configured to be receivable in the plurality of elongated recesses formed in the upper surface of the upper deck of an identical pallet, wherein the portions of the plurality of runners extend between immediately adjacent pairs of the plurality of feet, wherein the plurality of elongated recesses each include three foot portions, each for receiving one of the plurality of feet of the identical pallet, and two elongated recesses extending between each adjacent pair of the plurality of feet.

* * * * *